US006027193A

United States Patent [19]

Domenig et al.

[11] Patent Number: 6,027,193

[45] Date of Patent: Feb. 22, 2000

[54] TWO-PART UNDERMOUNT DRAWER GUIDE ASSEMBLY WITH PIVOT MEMBER

[75] Inventors: Georg Domenig; Andreas Moser; Joseph Larson, all of Kernersville, N.C.

[73] Assignee: Grass America, Inc., Kernersville, N.C.

[21] Appl. No.: 09/258,871

[22] Filed: Feb. 26, 1999

[51] Int. Cl.[7] ..... A47B 88/00

[52] U.S. Cl. ..... 312/334.14; 312/334.15; 312/334.27

[58] Field of Search ..... 312/334.6, 334.13, 312/334.14, 334.15, 334.21, 334.27, 334.29, 334.31, 334.33, 334.42

[56] References Cited

U.S. PATENT DOCUMENTS

| | | | |
|---|---|---|---|
| 1,089,514 | 3/1914 | Wagemaker | 312/334.13 |
| 1,951,390 | 3/1934 | Barker . | |
| 2,142,897 | 1/1939 | Harmon . | |
| 2,220,319 | 5/1940 | Zalkind . | |
| 2,361,116 | 10/1944 | Mayer . | |
| 2,418,244 | 4/1947 | Baird . | |
| 2,484,377 | 10/1949 | Eramo et al. . | |
| 2,575,566 | 11/1951 | Shand | 312/334.15 |
| 3,053,582 | 9/1962 | Wenger . | |
| 3,482,888 | 12/1969 | Anderson | 312/344.15 X |
| 3,716,284 | 2/1973 | Vogt . | |
| 3,926,491 | 12/1975 | Greer . | |
| 4,037,897 | 7/1977 | Siggia . | |
| 4,557,531 | 12/1985 | Rock et al. . | |
| 4,558,908 | 12/1985 | Rock et al. . | |
| 4,564,248 | 1/1986 | Grass . | |
| 4,606,588 | 8/1986 | Koch . | |
| 4,659,237 | 4/1987 | Rapp . | |
| 4,728,200 | 3/1988 | Rock et al. . | |
| 4,955,160 | 9/1990 | Rock . | |
| 4,995,683 | 2/1991 | Albiez . | |
| 5,020,868 | 6/1991 | Brunnert . | |
| 5,275,483 | 1/1994 | Rasmussen | 312/334.27 X |
| 5,433,517 | 7/1995 | Fleisch . | |
| 5,490,724 | 2/1996 | Domenig . | |
| 5,536,083 | 7/1996 | Brustle et al. . | |
| 5,641,216 | 6/1997 | Grass . | |
| 5,664,855 | 9/1997 | Lautenschlager et al. . | |
| 5,709,443 | 1/1998 | Lautenschlager | 312/334.14 |
| 5,775,787 | 7/1998 | Gasser . | |

FOREIGN PATENT DOCUMENTS

| | | | |
|---|---|---|---|
| 0463561 | 3/1950 | Canada | 312/334.15 |
| 0780071 A2 | 6/1997 | European Pat. Off. . | |
| 2946113 A1 | 5/1981 | Germany . | |
| 3942518 A1 | 5/1990 | Germany . | |
| 43444 | 6/1938 | Netherlands . | |
| 195282 | 1/1938 | Switzerland . | |
| 608384 | 9/1948 | United Kingdom . | |
| WO 97/18732 A1 | 5/1997 | WIPO . | |

OTHER PUBLICATIONS

Mepla, Inc., "Motion by MEPLA: Dynamic Drawer Slides".
Mepla Inc., "Motion by MEPLA: Dynamic Drawer Slides", (date unknown).

*Primary Examiner*—Peter M. Cuomo
*Assistant Examiner*—Stephen Vu
*Attorney, Agent, or Firm*—John M. Harrington; Kilpatrick Stockton LLP

[57] ABSTRACT

A drawer guide assembly for a movable structure such as a drawer in a furniture article allows for full or nearly full extension of the movable structure. A drawer guide assembly comprises a pull-out rail, a swing arm with one end hinged to the pull-out rail and having a track roller coupled thereto, a guide rail supporting the pull-out rail and communicating with the track roller, and a curved track disposed on the guide rail for receiving the track roller when a drawer is pushed into a furniture article.

18 Claims, 5 Drawing Sheets

TWO-PART UNDERMOUNT DRAWER GUIDE ASSEMBLY WITH PIVOT MEMBER

BACKGROUND OF THE INVENTION

1. Field of the Invention

The present invention relates to a new and improved drawer guide assembly for a movable structure such as a drawer in a furniture article which allows for full or nearly fall extension of the movable structure. The drawer guide assembly contains mirror image assemblies, each comprising a guide rail mountable to the interior of a furniture article in a generally horizontally disposed position and a pull-out rail movable therein and mountable to the drawer, or other movable structure. Both the guide and pull-out rails are provided with one or more fix-position mounted rotatable rollers and upper and lower ledges which are in rolling contact with complimentary rotatable rollers, thus enabling forward and rearward horizontal movement of the pull-out rail and carried structure on the fixed guide rail.

2. Description of Prior Art

Various types of drawer guide assemblies are used for drawers housed by desks or cabinets and the like to enable extension of the drawers within the housing and the smooth and efficient operation thereof. Drawer guides are used in pairs with each two-part drawer guide including a drawer member, the pull-out rail, which is fastened either to the side of the drawer or underneath the drawer to support the drawer, and a guide rail fastened to the corresponding side of the interior of the furniture article. Fastening the pull-out rail underneath the drawer enables the use of a wider drawer within a drawer opening of a given width.

The majority of drawer guide assemblies limit the travel of the pull-out rail to a distance shorter than the depth of the associated drawer such that the rear wall of the fully open drawer remains within the associated cabinet; nearly full or full extension of the pull-out rail and thus the drawer itself is not possible. Assemblies of this type, called "partial slides," hinder visibility and accessibility of the rear region of the drawer which remains within the cabinet.

Drawer guide assemblies of the type of the present invention generally have a pull-out rail roller at or near the rear end of the pull-out rail and a guide rail roller at or near the front end of the guide rail. The pull-out rail roller rolls in a track within the guide rail and a portion of the pull-out rail serves as a rolling surface for the guide rail roller. Generally, such two-part drawer guides also include a stop means which limits the extension of the drawer to only about three-fourths of the way because as the pull-out rail roller rolls forward on the guide rail and approaches the guide rail roller the front of the drawer tends to sag or cantilever under the weight of the drawer and its contents.

Drawer guides which allow nearly full and full extension of the drawer, "full slides," and "over slides" in which the associated drawer can be withdrawn so far out of the cabinet that its rear wall is approximately flush with or even slightly in front of the front surface of the cabinet, are highly desirable.

Currently existing full slides are constructed as a combination of three parts rather than two parts, using either an additional rail member disposed between the pull-out rail and the guide rail, or an additional running rail portion which is tiltable about a vertical or horizontal axis. In the former construction, to enable full extension, an additional member is disposed between the pull-out rail and the guide rail in combination with additional rollers to prevent sagging or cantilevering of the drawer when fully extended. In the latter construction, as the drawer is extended outward an additional running rail portion is swung by an automatic control downward about a horizontal axis or outwardly in front of the rear wall of the drawer about a vertical axis such that the drawer may be slid out further. At full extension, the additional running rail portion is in alignment with the actual running rail, thereby making an additional opening pathway available to allow a complete opening of the drawer. In either construction, such three-part full extension drawer guides are highly complicated and very expensive. In order to obtain the desired advantages, such as easy running, a high load bearing ability, and a high transverse stability in the fully open state, these devices are constructed of multiple pieces which must be precisely manufactured and assembled at significantly high cost and labor intensity.

U.S. Pat. No. 5,709,443, for instances, presents a rather complicated and seemingly expensive drawer guide which has pivotably connected to the inner end of the running rail a hollow profile section which pivots from a position in which it is in alignment with the running rail to a position in which it is in the plane of the drawer bottom and substantially parallel to the rear wall of the drawer. Aligned orientation with respect to the actual running rail in the further open state is effected by means of cage mounted rolling bodies.

SUMMARY OF THE INVENTION

It is a feature and advantage of the present invention to provide a drawer guide assembly which overcomes the problems of cantilevering and sagging encountered in attempting to use a two-part drawer guide as a full extension drawer guide and the cost inefficiencies associated with the currently existing, multiple component three-part drawer guides.

It is a further feature and advantage of the present invention to provide a drawer guide assembly comprising a swing arm at the rear end of the pull-out rail which is constructed of minimal pieces, at a low cost, and is pivotable between horizontal and vertical positions, and a curved track attached near the rear end of the guide rail which allows the swing-arm to be guided into the vertical (end) position parallel to the rear wall of the drawer.

The general purpose of the present invention, which will be described subsequently in greater detail, is to provide a new and improved drawer guide to be used at each side of a drawer to guide movement of the drawer into and out of a cabinet which has all, and more, of the advantages of the prior art devices and none of the disadvantages.

To attain this purpose, a representative embodiment of the present invention is illustrated in the drawings. The drawer guide of the present invention makes use of a pull-out rail, shown in FIGS. 1 and 3, which is adapted for carrying a structure such as a drawer, and a guide rail, shown in FIGS. 2 and 4, which is adapted for mounting to the interior of an article of furniture, such as a cabinet, in a generally horizontally disposed position.

To overcome the problems of cantilevering and sagging encountered in attempting to use a two-part drawer guide as a full extension drawer guide and the cost inefficiencies associated with the currently existing, multiple component three-part drawer guides, the present invention provides a swing arm at the rear end of the pull-out rail which is constructed of minimal pieces and at a low cost and is pivotable between horizontal and vertical positions, and a curved track attached near the rear end of the guide rail which allows the swing-arm to be guided into the vertical (end) position parallel to the rear wall of the drawer. As the drawer is pulled out, the swing arm pivots down to a horizontal position, and when the drawer is fully extended, swing-arm cooperating guide means furnish additional leverage against sagging or cantilevering of the drawer. When the drawer is pushed in, as it approaches a fully closed position, the swing-arm cooperating guide means are engaged by the guide rail curved track so as to pivot the swing arm up to the vertical position to permit full closure of the drawer.

The swing arm of the present invention, while still allowing for full or nearly full extension of the drawer, is simply constructed of minimal pieces and thus provides a lower cost means for supporting and guiding in and out a movable structure such as a drawer in a furniture article. Since the prior art is comprised mostly of multiple-component brackets like those previously described, it can be appreciated that there is a continuing need for improvements to such devices. The present invention addresses the need for such improvements.

The pull-out rail of the present invention can be mounted in the advantageous so-called "bottom configuration"—on the underside of the base of a drawer directly adjacent the side wall projecting downwardly below the base,—or, if the side walls of the drawer are constituted by hollow profiles of metal or plastics material open at the underside, within the side wall. The guide rail is adapted for mounting to the interior of the furniture article in a generally horizontally disposed position.

In brief, the pull-out rail of the present invention includes: (1) a pull-out rail upper ledge in rolling contact with a guide rail front roller so as to enable forward and rearward horizontal movement of the pull-out rail and carried structure, (2) a pull-out rail rear roller in rolling contact with the guide rail upper ledge, (3) a pull-out rail inside lower ledge in rolling contact with the guide rail front roller, (4) a swing-arm pivotable about an axis extending perpendicular to the pull-out rail, and (5) a means for mounting the pull-out rail to a drawer or other carried object. Cooperating guide means (for example, one or more track rollers) are provided on the swing arm to hold the swing arm in its extended position in alignment with the pull-out rail during movement of the pull-out rail from the open position of the drawer over the major portion of the inward movement, and to pivot the swing arm increasingly into the upright end position parallel to the rear wall of the drawer when its inner end approaches the rear wall of the cabinet.

When the pull-out rail moves in the closing direction of the drawer and the closed position is approached the swing arm is held in an upright end position approximately at a 90° angle to the pull-out rail and nearly parallel to the rear wall of the cabinet. As the pull-out rail moves in the opening direction of the drawer, the swing arm lowers approximately 90° from its upright end position to its extended position in which it is aligned with the pull-out rail. As the is pull-out rail approaches its position of full extension, the swing arm, which is again in alignment with the actual pull-out rail, makes an additional opening pathway available so as to allow a complete opening of the drawer.

The guide rail, which is adapted for mounting to the cabinet, includes: a receiving "ramp" (e.g., a guide rail upper ledge) capable of receiving the pull-out rail rear roller and the swing arm guide means; a guide rail front roller in rolling contact with the receiving "ramp" included on the pull-out rail (e.g., the pull-out rail upper ledge); and a curved track (or receiving ramp) in contact with the swing arm guide means so as to cause the swing arm to pivot increasingly into the upright end position parallel to the rear wall of the drawer as the pull-out rail moves inward. The curvature of the curved track is a curvature sufficient to enable the raising of the swing-arm from its extended position to its upright end position during inward movement of the pull-out rail, and vice versa during outward movement of the pull-out rail.

In a preferred embodiment the pull-out rail includes an obliquely disposed retaining member (a detent) located in the front end area of the pull-out rail, which engages the guide rail front roller in a rearward position so as to resist forward movement of the pull-out rail and limit the extension of the drawer. Also preferred is the inclusion in the guide rail lower ledge at its distal end (preferably immediately subsequent to the point of attachment of the curved track) of a guide rail retaining member in the form of a downwardly sloping detent which serves as a rolling surface for the pull-out rail rear roller and has a run-in slope oriented in the same direction and preferably parallel to the run-in slope of the pull-out rail retaining member (detent). The guide rail retaining member improves the pull-in and staying closed behavior of the drawer, especially in the case of drawers of little net weight and small load capacity. Further, when the pull-out rail is moved inward (in the closing direction of the drawer), the pull-out rail rear roller and guide rail front roller simultaneously reach the guide rail retaining member and the pull-out rail retaining member, respectively; the pull-out rail rear roller rolls into the downwardly sloping area of the guide rail retaining member and the pull-out rail retaining member engages the guide rail front roller, causing the pull-out rail, under the weight of the drawer, to roll downward along the downward slope of the pull-out rail retaining member, thereby automatically closing the drawer.

In order to limit further rearward movement of the pull-out rail and the carried drawer in the rearwardly disposed closed position of the drawer (i.e., to prevent the swing-arm in it raised upright position from contacting the backwall of the cabinet), the guide rail upper ledge may be provided with a means for stopping further inward movement of the pull-out rail. In the preferred embodiment, the means for stopping further inward movement of the pull-out rail comprises inclusion on the guide rail (either on the guide rail upper ledge, or on the guide rail lower ledge immediately subsequent to the guide rail retaining member) of a pull-out rail inward stop means configured to prevent further inward movement of the pull-out rail at a predetermined point, for instance, the point at which the carried structure is fully within the cabinet (i.e., the drawer is closed). The pull-out rail inward stop means comprises a downwardly depending V-shaped projection formed in the guide rail upper ledge configured to engage the pull-out rail rear roller.

In a preferred embodiment, the pull-out rail upper ledge includes a downward depending flange which engages the guide rail front roller, effectively capturing the guide rail front roller between the pull-out rail upper ledge flange and the inside wall of the pull-out rail. Thus, when a lateral force is applied to the drawer or other object carried by the pull-out rail, the pull-out rail upper ledge flange prevents the pull-out rail from becoming disengaged from the guide rail front roller.

In a preferred embodiment, the guide rail also includes an upwardly projecting tab located on the outer side of the guide rail front roller (i.e., towards the cabinet wall) which, during movement of the pull-out rail, moves underneath the pull-out rail upper ledge between the pull-out rail outside wall and the pull-out rail upper ledge flange. In combination with the pull-out rail upper ledge flange, the guide rail upwardly projecting tab significantly reduces side-to-side movement (known as "side play") of the drawer.

Preferred means for mounting the pull-out rail to a drawer or other carried object include the addition of a pull-out rail mounting means immediately preceding the point of pivot of the swing-arm adapted for mounting of the pull-out rail to the end wall of a drawer and, either a mounting adaptation of the pull-out rail outside lower ledge for mounting to the bottom side of a side wall of a drawer (for instance, holes suitable for screws or nails), or a mounting adaptation of the outside wall of the pull-out rail for mounting of the outside wall of the pull-out rail to the inside of the side wall of a drawer.

If the mounting adaptation of the outside wall of the pull-out rail is used, it is preferred to also include the pull-out rail upper ledge flange. The pull-out rail upper ledge flange allows this type of mounting by providing a discrete passageway, distinct from the passageway formed by the pull-out rail upper ledge flange and the inside wall of the pull-out rail, in which the guide rail front roller can travel unobstructed and unimpeded by the presence of the means (for example, screws) necessary for mounting the pull-out rail outside wall to the side wall of the drawer.

Preferred means for mounting the guide rail to the inside wall of a cabinet or article of furniture are the inclusion of both a guide rail front mounting means located on the outer side of the guide rail front roller (i.e., towards the cabinet wall) and on the outer side of the upwardly projecting tab, and a guide rail rear mounting means located at the end point of the guide rail and configured so as to permit mounting of the guide rail to the end wall of the cabinet and subsequent to such mounting, lateral adjustment of the mounted guide rail.

Also preferred is the inclusion on the pull-out rail inside wall of a pull-out rail inside lower ledge and the inclusion of a downwardly depending flange on the guide rail upper ledge. The guide rail upper ledge flange, in cooperation with the guide rail lower ledge and the guide rail front roller, prevent disengagement of the pull-out rail. Additionally, during movement of the pull-out rail along the guide rail, the pull-out rail inside lower ledge, which rides underneath the guide rail upper ledge flange, prevents the drawer or carried object from contacting the cabinet frame in the event that the cabinet is in other than its normally upright position (for instance, during shipping of assembled cabinet / drawer units). The guide rail upper ledge flange, in cooperation with the swing-arm guide means (the swing-arm lower roller in the preferred embodiment, discussed below), also prevents the front-end of the pull-out rail and attached carried object from cantilevering out of the cabinet.

Further preferred is the inclusion of an extension of the pull-out rail inside lower ledge for mounting to the front wall of the drawer or carried object. The pull-out rail inside lower ledge extension provides both additional strength for the pull-out rail which prevents bowing of the rail, and a means for easy alignment of the pull-out rail on the drawer or carried object during assembly.

Also preferred, is the inclusion on the guide rail lower ledge of an upwardly depending flange. In addition to providing further strength to the guide rail to prevent disfigurement of the guide rail (e.g., bowing), the guide rail lower ledge flange, in conjunction with the downwardly depending flange on the guide rail upper ledge, provides a capture of the pull-out rail rear roller which prevents disengagement of the pull-out rail from the guide rail, for instance, in event of the cabinet being tipped from its normally disposed upright vertical position.

When the pull-out rail is mounted in the advantageous bottom configuration, inclusion of the pull-out rail retaining member, necessarily prevents the guide rail upper ledge from contacting the bottom of the drawer other than at the highest point of the pull-out rail retaining member. Accordingly, if bottom configuration mounting is desired, it is preferred that the pull-out rail include a raised region near the rear end of the pull-out rail, which is raised to a height parallel with the highest point of the pull-out rail retaining member. The pull-out rail rear raised region provides a second point of contact for the pull-out rail on the drawer bottom, thus facilitating mounting of the pull-out rail parallel to the drawer bottom, strengthening the pull-out rail, and reducing the likelihood of disfigurement of the pull-out rail.

In the preferred embodiment, the swing arm guide means comprise an upper roller (also referred to as a track roller) and a lower roller (also referred to as a ledge roller), the swing arm upper roller being located forward of, and above, the swing arm lower roller. As the drawer is pulled out, the swing arm pivots down to the horizontal position, the upper roller rolls on the topside of the upper ledge of the guide rail, and the lower roller rolls underneath (on the innerside) of the upper ledge. As the drawer is fully extended, the swing-arm lower roller, spaced rearward from the pull-out rail rear roller, furnishes additional leverage against sagging or cantilevering of the drawer. When the drawer is pushed in, as it approaches a fully closed position, the swing-arm upper roller is engaged by the curved track to pivot the swing member up to the vertical position, so the drawer can be fully closed.

The swing arm lower roller may be in rolling contact with the underside of the curved track. However, it is preferred that the swing arm lower roller be configured so as not to contact the underside of the curved track; such a configuration of the swing arm lower roller allows for a greater likelihood of unimpeded movement of the pull-out rail along the guide rail in the event that either the pull-out rail or the guide rail is mounted in other than the desired/ideal position. Contact between the swing-arm upper roller and the guide rail upper ledge also prevents the front-end of the drawer member from cantilevering out of the drawer.

Also preferred, is inclusion on the pull-out rail immediately preceding the pivot point of the swing arm of a pull-out rail outward stop means configured to prevent further outward movement of the pull-out rail, at a predetermined point in which the carried structure is nearly fully, or fully, extended from the cabinet (e.g., the drawer is open). In the preferred embodiment, the pull-out rail outward stop means comprises a downwardly depending V-shaped projection formed in the pull-out rail upper ledge and configured to engage the guide rail front roller.

In a preferred embodiment, the pull-out rail and the guide rail each include a soft bumper to absorb and minimize shock and the noise associated therewith. Specifically, the rear-end of the pull-out rail upper ledge includes one or more pull-out rail back bumper(s) located and configured so as to minimize impact between the swing-arm and the pull-out rail upper ledge as the swing-arm pivots down to the horizontal position in which it rests on top of the pull-out rail upper ledge, for instance, as the drawer is opened and moves outward from the cabinet. The front end of the guide rail can also be equipped with a guide rail front bumper(s) positioned and configured so as to minimize impact between the inner side of the drawer front and the front end of the guide rail. The addition of the guide rail front bumper eliminates the need for the customarily used drawer front bumpers. Both the guide rail front bumper and the pull-out rail back bumper are preferably constructed of soft felt or rubber of an appropriate density to absorb shock and eliminate noise.

The present invention is intended for use in pairs, that is, a right-hand drawer guide to support the right side of a drawer and a left-hand drawer guide to support the left side of the drawer. A left-hand drawer guide is a mirror image of a right-hand drawer guide and vice versa. While a right-hand guide rail is illustrated in the drawings, the specification and claims relate equally to both left-hand and right-hand drawer guide assemblies.

There has been outlined rather broadly the more important features of the invention in order that the detailed description thereof that follows may be better understood and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangement of the components set forth in the following description or illustrated in the drawings.

The invention is capable of other embodiments and of being practiced and carried out in various ways. It is to be further understood that the phraseology and terminology employed herein are for the purpose of description and should not be regarded as limiting. As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention. The abstract is neither intended to define the invention of the application, which is measured by the claims, nor is it intended to be limiting as to the scope of the invention in any way.

BRIEF DESCRIPTION OF THE DRAWINGS

The invention will be better understood and objects other than those set forth above will become apparent when consideration is given to the following detailed description. Such description makes reference to the annexed drawings wherein.

DESCRIPTION OF THE PREFERRED EMBODIMENT

Figure 1:
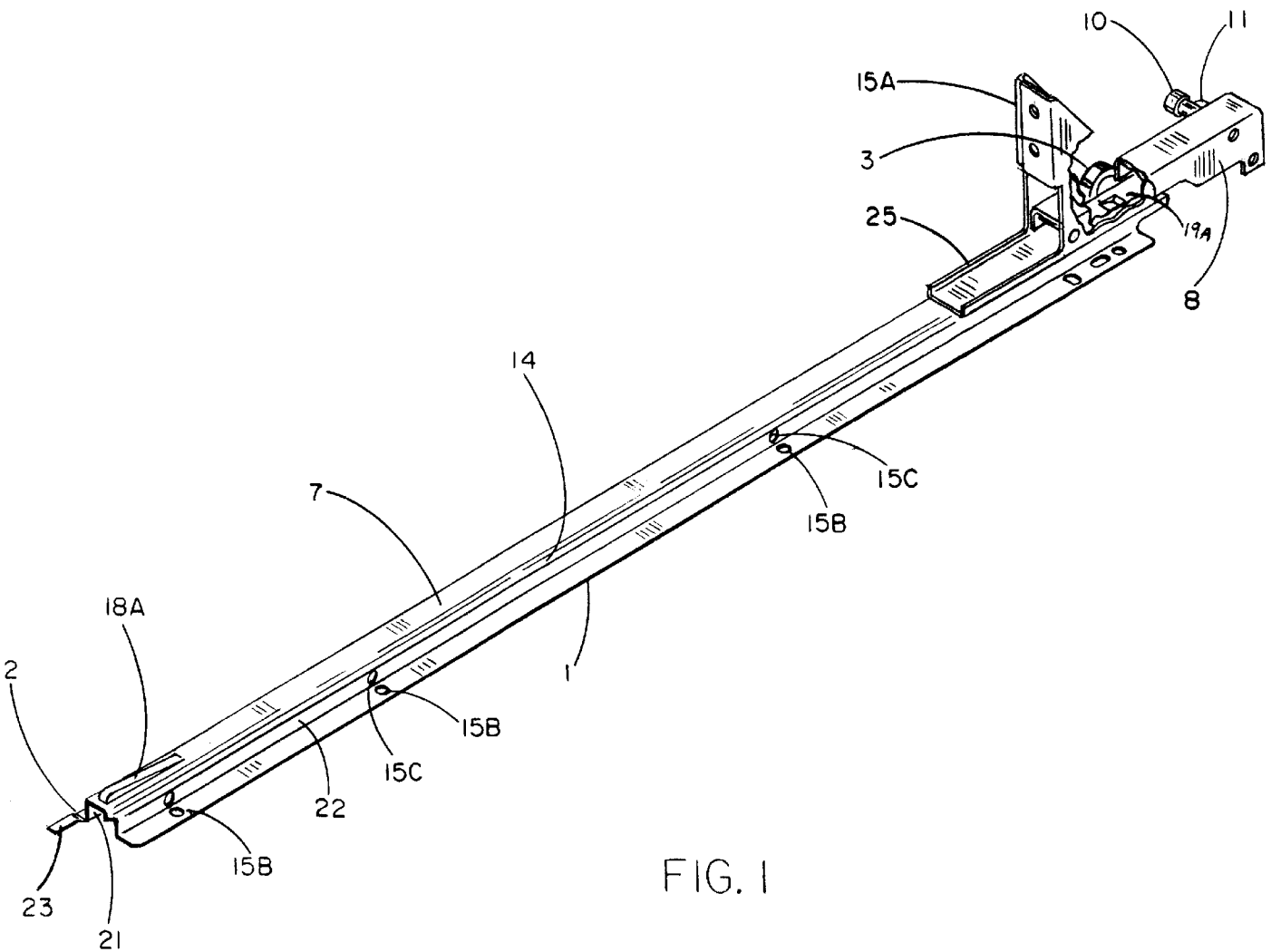
FIG. 1 is a perspective view of the pull-out rail and attached swing-arm for use on the right-side (determined by looking at the front) of the drawer or carried object.
Figures 2, 2A:
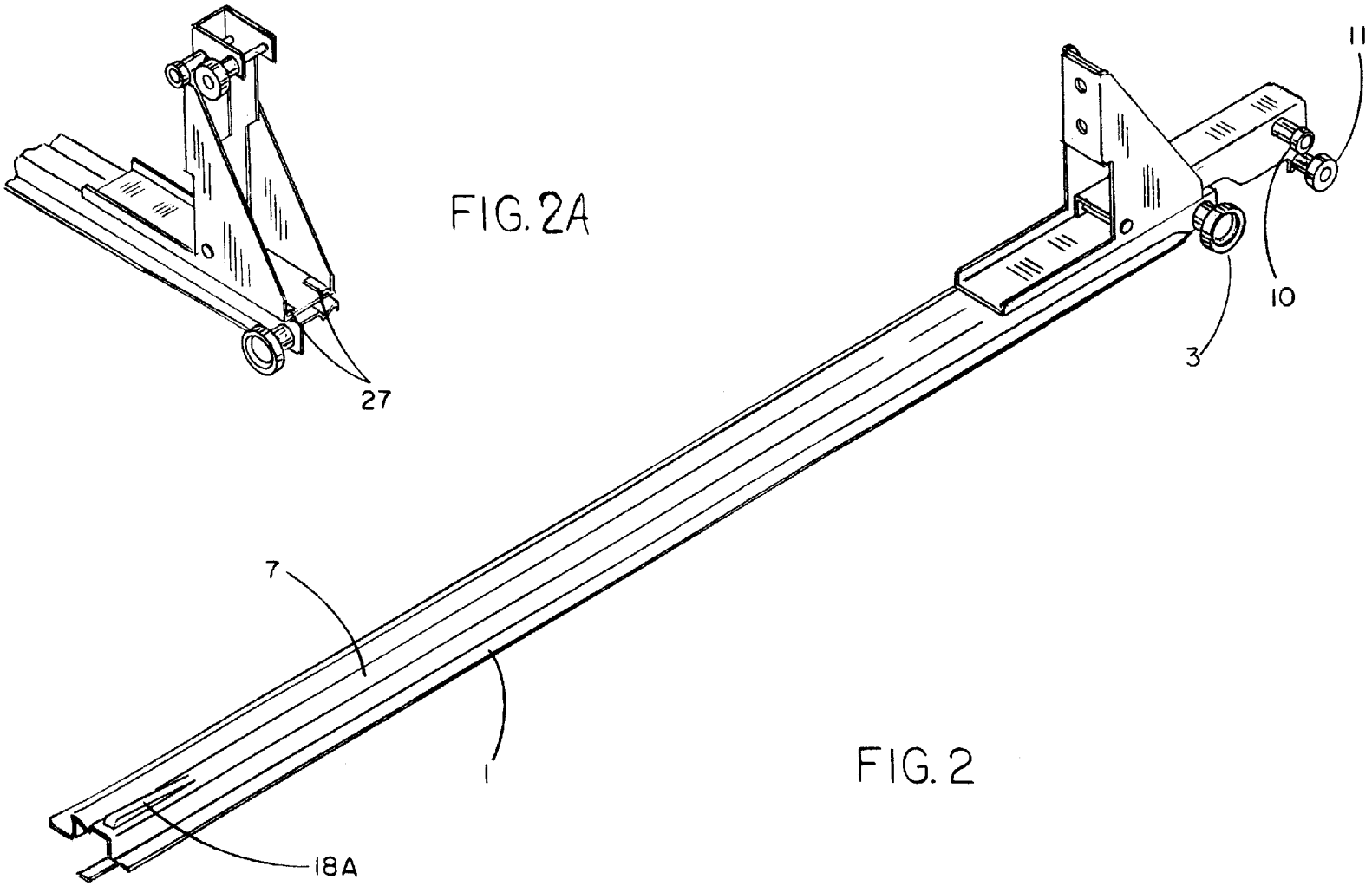
FIGS. 2 and 2A are a perspective view of the pull-out rail and attached swing-arm for use on the left-side (determined by looking at the front) of the drawer or carried object.

Referring now to the drawings and specifically to FIGS. 1 and 2, the preferred embodiment of the pull-out rail of the present invention comprises a profiled rail including a pull-out rail upper ledge 7 having a downward depending flange 14 configured so as to engage a guide rail front roller 4, a pull-out rail retaining member 18A, said pull-out rail retaining member 18A comprising an upwardly projecting detent of a known slope configured to engage the guide rail front roller 4 so as to resist forward movement of the pull-out rail, and a pull-out rail mounting means 15A adapted for mounting of the pull-out rail to the end wall of a drawer.

In an embodiment of the present invention, the profiled rail comprising the pull-out rail also includes a pull-out rail inside wall 21 downwardly depending from the pull-out rail upper ledge 7, having a pull-out rail inside lower ledge 2 projecting outward from the pull-out rail inside wall 21 configured so as to enable the pull-out rail inside lower ledge 2 to move underneath the guide rail upper ledge flange 16 during movement of the pull-out rail on the guide rail, said pull-out rail inside lower ledge 2 having a pull-out rail inside lower ledge extension 23 configured for mounting to the front wall of a drawer or other object carried by the pull-out rail in a predetermined location.

In an embodiment of the present invention, the profiled rail comprising the pull-out rail further includes a pull-out rail outside wall 22 downwardly depending from the pull-out rail upper ledge 7 having a mounting adaptation 15C for mounting of the outside wall of the pull-out rail 22 to the inside of the side wall of a drawer, a pull-out rail outside lower ledge 1 projecting outward from the pull-out rail outside wall 22; said pull-out rail outside lower ledge 1 including a mounting adaptation 15B for mounting the pull-out rail outside lower ledge 1 to the bottom side of a side wall of a drawer; said pull-out rail outside wall 22 along with the pull-out rail inside wall 21 and the pull-out rail upper ledge 7 defining an inner hollow space.

In an embodiment of the present invention, the profiled rail comprising the pull-out rail additionally includes a pull-out rail rear roller 3, as well as a pull-out rail outward a stop means 19A configured to prevent further outward movement of the pull-out rail at a predetermined point, said pull-out rail outward stop 19A means comprising a downwardly depending V-shaped projection formed in the pull-out rail upper ledge 7 and configured to engage the guide rail front roller 4.

In an embodiment of the present invention, the profiled rail comprising the pull-out rail also includes (1) a swing arm 8 mounted immediately subsequent to the pull-out rail mounting means 15A and pivotable approximately 90° about an axis extending perpendicular to the pull-out rail, said swing arm 8 including a swing arm upper roller 10 and a swing arm lower roller 11, said swing arm upper roller 10 being located forward of and above the swing arm lower roller 11 and configured so as to roll on the topside of an upper ledge 5A of the guide rail and on the innerside of the curved track 9A so as to pivot the swing member up to the vertical position, said swing-arm lower roller 11 being configured so as roll on the underneath (on the innerside) of an upper ledge 5B of the guide rail and so as not to contact the underside of the curved track 9B, and said swing arm upper roller 10 and swing-arm lower roller 11 being configured so as to hold the swing arm in an extended position in alignment with the pull-out rail during movement of the pull-out rail from an open (extended) position over a major portion of inward movement, and pivot the swing arm increasingly into an upright end (closed) position parallel to a rear wall of the drawer as the pull-out rail approaches a rear wall of a cabinet, (2) a pull-out rail back bumper 27 located towards the rear-end of the pull-out rail upper ledge 7 and configured so as to minimize impact between the swing-arm 8 and the pull-out rail upper ledge 7, and a raised region 25 near the rear end of the pull-out rail, which is raised to a height parallel with the highest point of the pull-out rail retaining member 18A.

Figure 3:
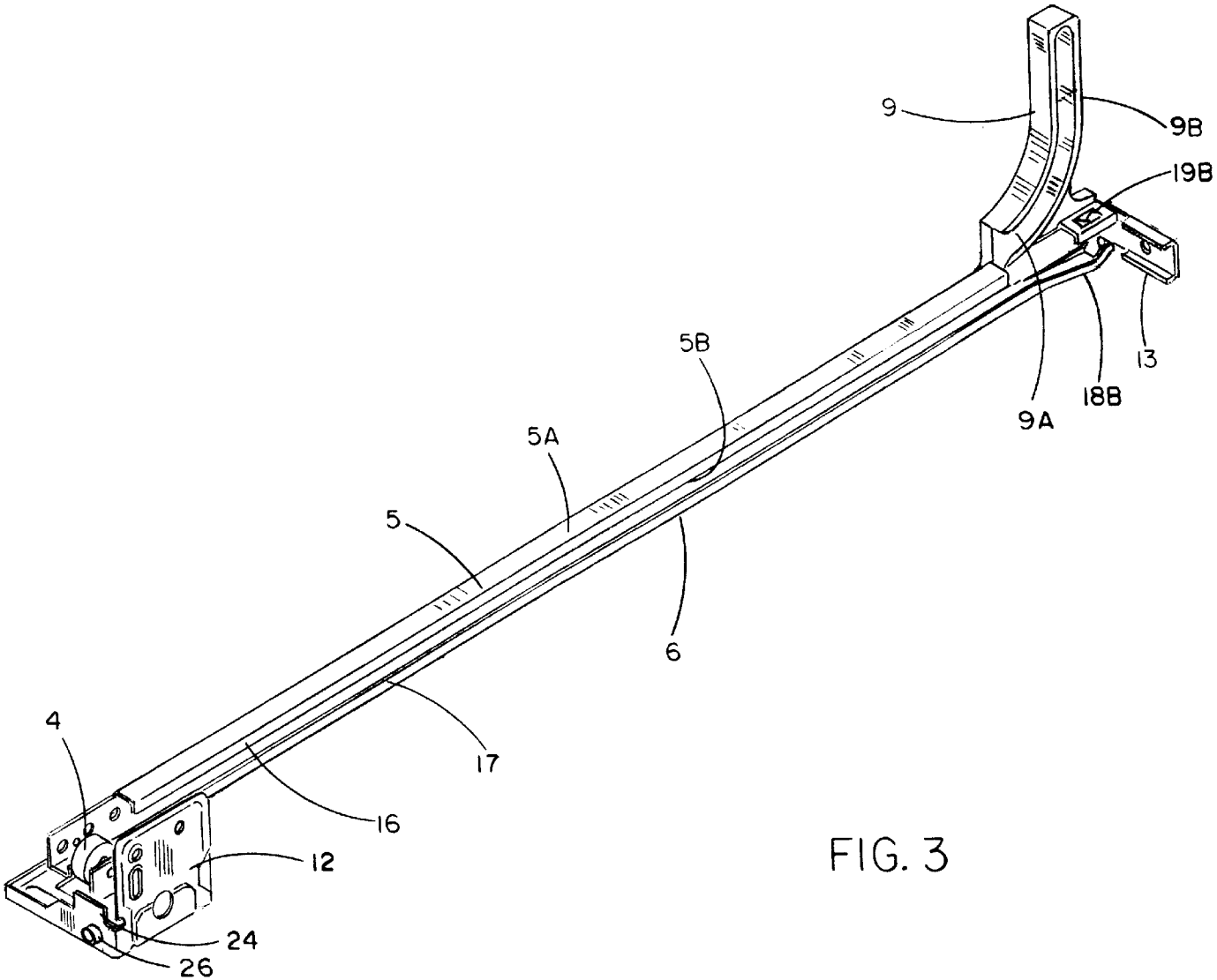
FIG. 3 is a perspective view of the guide rail for use on the right-side (determined by looking at the front) of the cabinet.
Figure 4A:
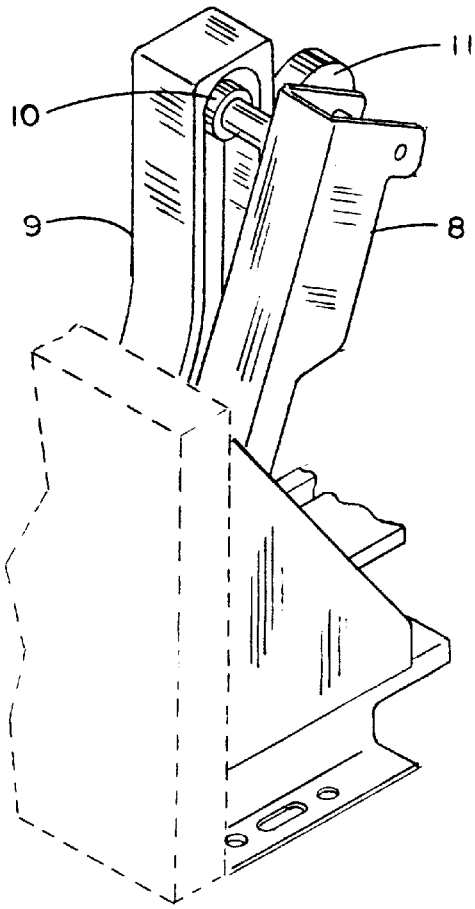
FIGS. 4A and 4B are perspective views of the rear-end portion of the pull-out rail and attached swing-arm coupled with the guide rail for use on the rights-side (determined by looking at the front) of the drawer and cabinet.
Figure 4B:
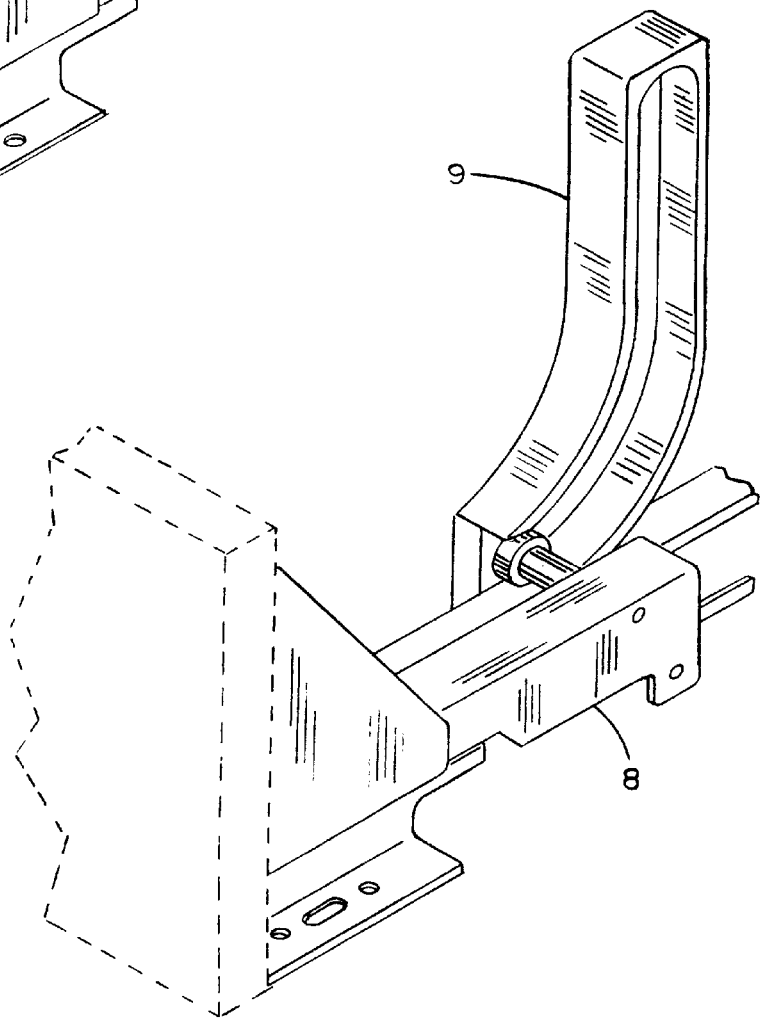
Figure 5:
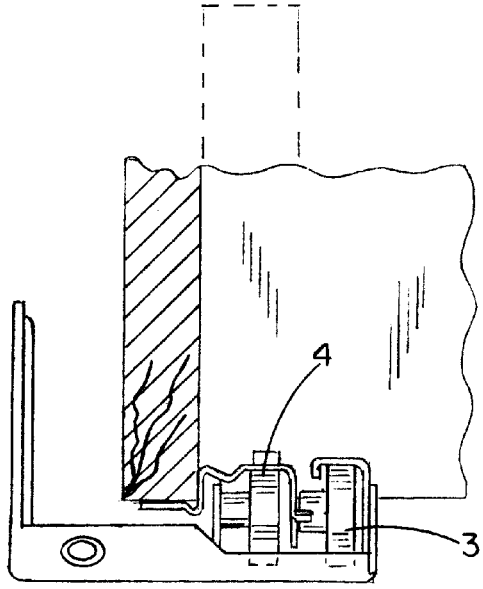
FIG. 5 is a front view of the front-end of the right-side wall of the drawer mounted on the pull-out rail and coupled with the guide rail; the drawer is in the fully closed position.
Figure 6:
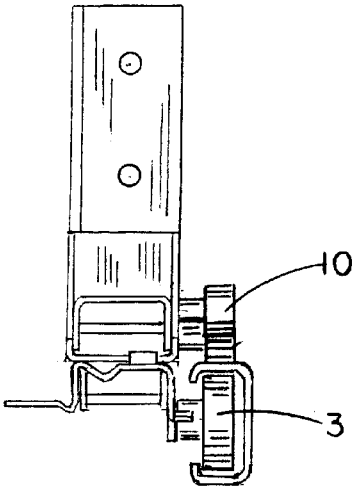
FIG. 6 is an end view of the pull-out rail and attached swing-arm coupled with the guide rail in which the swing-arm is in the lowered position in which it is aligned with the pull-out rail.
Figure 7:
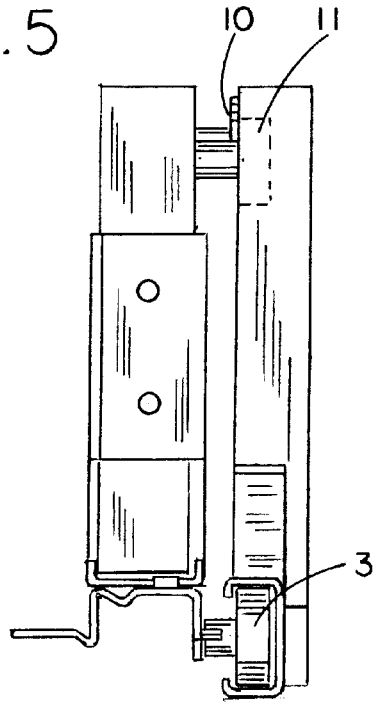
FIG. 7 is an end view of the pull-out rail and attached swing-arm coupled with the guide rail in which the swing-arm is in the upright end position approximately at a 90° angle to the pull-out rail and nearly parallel to the rear wall of the cabinet.

Referring to FIG. 3, the preferred embodiment of the guide rail of the present invention comprises a profiled rail including a guide rail upper ledge 5 in rolling contact with the pull-out rail rear roller 3, a guide rail front roller 4 in rolling contact with the pull-out rail upper ledge 7, a curved track 9 in rolling contact with the swing-arm upper roller 10 during inward movement of the pull-out rail as the drawer carried by the pull-rail approaches the end of the cabinet, said curved track 9 being of a curvature sufficient to cause the raising of the swing-arm 8 from the extended position in alignment with the pull-out rail to the upright end (closed) position parallel to the rear wall of the drawer as the pull-out rail approaches the rear wall of the cabinet, and a guide rail lower ledge 6 in rolling contact with the pull-out rail rear roller 3.

In an embodiment of the present invention, the profiled rail comprising the guide rail also includes guide rail retaining member 18B in the form of a downwardly sloping detent which serves as a rolling surface for the pull-out rail rear roller 3 and has a run-in slope oriented in the same direction and preferably parallel to the run-in slope of the pull-out rail retaining member (detent) 18A, said guide rail retaining member 18B being located in the guide rail lower ledge 6 immediately subsequent to the point of attachment of the curved track 9.

In an embodiment of the present invention, the profiled rail comprising the guide rail further includes a pull-out rail inward stop means 19B located on the guide rail upper ledge 5 immediately subsequent to the guide rail retaining member 18B and configured to prevent further inward movement of the pull-out rail at a predetermined point, said pull-out rail inward stop means 19B comprising a downwardly depending V-shaped projection formed in the guide rail upper ledge 5 configured to engage the pull-out rail rear roller 3, and an upwardly projecting tab 24 located on the outer side of the guide rail front roller 4 configured so as, during movement of the pull-out rail, to move underneath the pull-out rail upper ledge 7 between the pull-out rail outside wall 22 and the pull-out rail upper ledge flange 14.

In an embodiment of the present invention, the profiled rail comprising the guide rail additionally includes a guide rail upwardly depending flange 17 on the guide rail lower ledge 6, a guide rail downwardly depending flange 16 on the guide rail upper ledge 5, a guide rail front bumper 26 positioned on the front end of the guide rail and configured so as to minimize impact between the inner side of the drawer front and the front end of the guide rail, a guide rail front mounting means 12 located on the outer side of the guide rail front roller 4 and on the outer side of the upwardly projecting tab 24, and a guide rail rear mounting means 13 located at the end point of the guide rail and configured so as to permit mounting of the guide rail to the end wall of the cabinet and subsequent to such mounting lateral adjustment of the mounted guide rail.

Obviously, any number of materials may be used to form the drawer guide assemblies described herein, and exceptional success has been experienced by the use of rigid and semi-rigid plastic or metal materials, although other materials having similar physical properties may be utilized.

With respect to the descriptions set forth above, optimum dimensional relationship for the parts of the invention (to include variations in size, materials, shape, form, function and manner of operation, assembly and use) are deemed readily apparent and obvious to those skilled in the art, and all equivalent relationships to those illustrated in the drawings and described in the specification are intended to be encompassed herein.

The foregoing is considered as illustrative only of the principles of the invention. Since numerous modifications and changes will readily occur to those skilled in the art, the foregoing is not intended to limit the invention to the exact construction and operation shown and described, and all suitable modifications and equivalents falling within the scope of the appended claims are deemed within the present inventive concept.

The features of the present invention, together with the other objects of the invention, and along with the various features of novelty which characterize the invention, are pointed out with particularity in the claims annexed to and forming a part of this disclosure. For a better understanding of the invention, its operating advantages and the specific objects attained by its uses, references made to the accompanying drawings and descriptive matter in which like characters of reference designate like parts throughout the several views.

What is claimed is:

1. A drawer guide assembly, comprising:

a pull-out rail having front and rear ends;

a swing arm having first and second end portions, with the first end portion hinged to the pull-out rail proximate the rear end of the pull-out rail and swingable in a plane;

a track roller coupled to the second end portion of the swing arm;

a guide rail having front and rear ends, the guide rail supporting the pull-out rail and having a curved track disposed proximate the rear end of the guide rail in a plane substantially parallel to the plane in which the swing arm is swingable, the track roller being receivable in the curved track; and a pull-out rail roller coupled to the pull-out rail and receivable by the guide rail.

2. The assembly of claim 1, wherein the pull-out rail roller is disposed proximate the rear end of the pull-out rail.

3. The assembly of claim 2, wherein the pull-out rail is mounted to a bottom of a drawer.

4. The assembly of claim 2, further comprising a ledge roller coupled to the swing arm.

5. The assembly of claim 4, wherein the ledge roller is disposed below the track roller.

6. The assembly of claim 2, wherein the guide rail further comprises a pull-out rail receiving ramp in which the pull-out rail roller is receivable.

7. The assembly of claim 6, wherein the guide rail has a guide rail roller disposed proximate the front end of the guide rail, and wherein the pull-out rail further comprises a guide rail receiving ramp in which the guide rail roller is receivable.

8. The assembly of claim 1, further comprising a ledge roller coupled to the swing arm and disposed below the track roller.

9. A drawer guide assembly comprising:

a guide rail having front and rear ends;

a pull-out rail having front and rear ends and supported on the guide rail;

a swing arm having first and second end portions, with the first end portion hinged to the pull-out rail proximate the rear end of the pull-out rail;

a track roller coupled to the swing arm;

a ledge roller coupled to the swing arm and disposed below the track roller; and a guide rail roller disposed proximate the front end of the guide rail in rolling contact with the pull-out rail;

wherein the ledge roller is receivable by the guide rail.

10. A drawer guide assembly comprising:

a pull-out rail having a pull-out rail rear roller, a pull-out rail upper ledge, and a swing arm with swing arm guide means;

a guide rail having a guide rail upper ledge in rolling contact with the pull-out rail rear roller and the swing arm guide means, the guide rail having a curved track;

a guide rail front roller in rolling contact with the pull-out rail upper ledge; and the curved track in contact with the swing arm guide means for causing the swing arm to swing substantially 90 degrees relative to the pull-out rail.

11. The drawer guide assembly of claim 10, wherein the curved track comprises an arcuate portion which defines an arc of substantially 90 degrees.

12. A guide rail assembly for carrying a structure in and out of an article of furniture, said guide rail assembly comprising.

a guide rail having a guide rail front roller and guide rail upper and lower ledges;

a pull-out rail having an upper ledge in rolling contact with the guide rail front roller;

a pull-out rail rear roller in rolling contact with the guide rail upper ledger;

a pull-out rail inside lower ledge in rolling contact with the guide rail roller;

the pull-out rail having front and rear ends and a longitudinal axis;

a swing arm pivotable about an axis that is perpendicular to the longitudinal axis of the pull-out rail;

means for holding the swing arm in an extended position in alignment with the longitudinal axis of the pull-out rail and for pivoting the swing arm to an upright position relative to the longitudinal axis of the pull-out rail; and a pull-out rail retaining member disposed obliquely relative to the longitudinal axis of the pull-out rail and positioned proximate the front end of the pull-out rail, the retaining member engaging the guide rail front roller in a rearward position of the pull-out rail relative to the guide rail.

13. A guide rail assembly for carrying a structure in and out of an article of furniture, said guide rail assembly comprising:

a guide rail having front and rear ends, a guide rail front roller and guide rail upper and lower ledges;

a pull-out rail having an upper ledge in rolling contact with the guide rail front roller;

a pull-out rail rear roller in rolling contact with the guide rail upper ledger;

a pull-out rail inside lower ledge in rolling contact with the guide rail roller;

the pull-out rail having front and rear ends and a longitudinal axis;

a swing arm pivotable about an axis that is perpendicular to the longitudinal axis of the pull-out rail;

means for holding the swing arm in an extended position in alignment with the longitudinal axis of the pull-out rail and for pivoting the swing arm to an upright position relative to the longitudinal axis of the pull-out rail; and a guide rail detent with a run-in slope which slopes downward toward the rear end of the guide rail for engaging the pull-out rail rear roller.

14. The guide rail assembly of claim 13, further comprising a detent disposed proximate the front end of the pull-out rail and having a run-in slope which slopes upward toward the front end of the pull-out rail substantially parallel to the run-in slope of the guide rail lower ledge.

15. A guide rail assembly for carrying a structure in and out of an article of furniture comprising;

a guide rail having a guide rail front roller and guide rail upper and lower ledges;

a pull-out rail having an upper ledge in rolling contact with the guide rail front roller;

a pull-out rail rear roller in rolling contact with the guide rail upper ledger;

a pull-out rail inside lower ledge in rolling contact with the guide rail roller;

the pull-out rail having front and rear ends and a longitudinal axis;

a swing arm pivotable about an axis that is perpendicular to the longitudinal axis of the pull-out rail;

means for holding the swing arm in an extended position in alignment with the longitudinal axis of the pull-out rail and for pivoting the swing arm to an upright position relative to the longitudinal axis of the pull-out rail; and means for limiting inward movement of the pull-out rail relative to the guide rail.

16. The guide rail assembly of claim 15, wherein the limiting means further comprises stop means disposed on the guide rail for limiting inward movement of the pull-out relative to the guide rail.

17. The guide rail assembly of claim 16, wherein the stop means further comprises a substantially V-shaped downwardly depending projection formed in the guide rail for engaging the pull-out rail rear roller.

18. The guide rail assembly of claim 17, wherein the V-shaped projection is disposed guide rail upper ledge.

* * * * *